US005687520A

United States Patent [19]

Stranahan et al.

[11] Patent Number: 5,687,520

[45] Date of Patent: Nov. 18, 1997

[54] SEALING SYSTEM FOR LOG BUILDINGS

[76] Inventors: David A. Stranahan, R.D. #3, Box 3273A, Lake George, N.Y. 12845; Mary T. Schuh, P.O. Box 295, Lake Luzerene, N.Y. 12846

[21] Appl. No.: 671,267

[22] Filed: Jun. 26, 1996

[51] Int. Cl.[6] ..... E04B 1/10

[52] U.S. Cl. ..... 52/233; 52/741.4; 52/742.13; 52/747.1; 52/747.12

[58] Field of Search ..... 52/233, 741.4, 52/742.1, 742.13, 747.1, 747.12

[56] References Cited

U.S. PATENT DOCUMENTS

| | | | |
|---|---|---|---|
| 1,219,272 | 3/1917 | Edison . | |
| 1,943,033 | 1/1934 | Midby . | |
| 2,130,231 | 9/1938 | Forciea . | |
| 2,563,703 | 8/1951 | Bonney . | |
| 3,342,033 | 9/1967 | Crouch et al. . | |
| 3,527,005 | 9/1970 | Slavens . | |
| 3,970,401 | 7/1976 | Lubeck . | |
| 3,992,838 | 11/1976 | Vizziello . | |
| 4,126,977 | 11/1978 | Chisum . | |
| 4,154,036 | 5/1979 | Moss et al. | 52/233 X |
| 4,279,108 | 7/1981 | Collister, Jr. | 52/233 |
| 4,305,238 | 12/1981 | Harward . | |
| 4,488,389 | 12/1984 | Farmont . | |
| 4,590,729 | 5/1986 | Hegazi . | |
| 4,649,683 | 3/1987 | Dolata . | |
| 4,731,971 | 3/1988 | Terki . | |
| 4,903,447 | 2/1990 | McDade . | |
| 4,918,888 | 4/1990 | Giles et al. . | |
| 4,951,435 | 8/1990 | Beckdorf . | |
| 5,020,289 | 6/1991 | Wrightman . | |
| 5,125,442 | 6/1992 | Hendrickson . | |

*Primary Examiner*—Christopher T. Kent
*Attorney, Agent, or Firm*—Schmeiser, Olsen & Watts

[57] ABSTRACT

A sealing system designed for use in buildings having log construction. The system makes use of horizontally-oriented channels that are located along the top and bottom face of each log. After the building has been assembled, vertically-oriented bores are drilled into each course of logs. The bore is located so that they interconnect a horizontal channel. Once the bore has been drilled, a liquid sealing material such as caulking is pumped into the bore where it then flows into and fills the horizontal channel.

6 Claims, 3 Drawing Sheets

SEALING SYSTEM FOR LOG BUILDINGS

FIELD OF THE INVENTION

The invention is in the field of building construction. More particularly, the invention is an improved system for sealing log buildings against air infiltration and heat loss. The invention makes use of a unique sealing system designed to ensure a long-lasting and air-tight seal between the rigid members that form the exterior of the building.

BACKGROUND OF THE INVENTION

Many people choose to live in log homes due to the solidity and rustic comfort provided by the log construction. These homes are now made using improved construction techniques that make the homes extremely energy efficient and durable. However, there are certain problems inherent in the design of log buildings that have not been completely overcome by modern construction techniques.

Two primary problems are air infiltration and heat loss through the exterior of the building. A log home has a large number of joints and other areas where air and/or heat can pass around or between the logs if inadequate or damaged seals are present. Every edge where two logs contact is a possible area where air and/or heat can pass. Given the typically long lengths of the logs used in log building construction, proper sealing over the entire top and bottom length of each log is required but difficult to accomplish.

Standard techniques of sealing log buildings involve the use of spline caulking, chinking and/or gaskets at the joints and between each log. However, the logs in a log building tend to shift and warp over time and thereby create gaps in the sealing materials. This problem is exacerbated by the fact that the sealing materials do not necessarily completely match the inexact surfaces found on the log. This problem is further exacerbated by the fact that many sealing materials become stiff and contract over time and therefore cannot change shape to match the contours of the logs. As a result, most log building require regular re-caulking and/or re-chinking.

SUMMARY OF THE INVENTION

The invention is a sealing system specially designed to prevent the air infiltration and heat loss problems often associated with log buildings. The system takes advantage of the workability of the wood both prior to and after the building's construction. The system also makes use of the stretchability and stickiness nature of the sealing material.

The improved sealing system involves a number of specific steps both prior to and after assembly of the building. The first step is to insert a long groove such as by machine or hand in the top and bottom face of each log prior to assembly of the building. The grooves are designed so that after assembly, the grooves in adjacent logs will be aligned to form multiple horizontally-oriented thru-channels in each of the building's walls. The grooves in the logs are also used to provide sealing areas when they are located adjacent to the structural members that form the building's roof, foundation, window and door structures.

Once two logs have been horizontally assembled into a course and an additional course of horizontal logs stacked thereon, the second step of the system includes vertical bores being drilled at each vertical joint of the adjoining logs and at other predetermined areas. These bores are designed to pass through each of the horizontally-oriented thru-channels located between adjacent logs of the building's walls and also through any channels created between the logs and other structural parts of the building.

After the vertical bores have been drilled, the third step of the invention involves injecting a large quantity of a viscous liquid caulking/sealing material such as Log Builder, a urethane caulk, made by Sashco Sealant of Commerce City, Colo. into each of the vertical bores. The liquid material is maintained under pressure until it has flowed down the vertical bores and completely filled each of the horizontally-oriented thru- channels. In this manner, the caulking/sealing material completely seals all of the joints and mating areas between the logs and between the logs and other structures of the building.

It should be noted that the above-described method creates most of the building's seals after the assembly of each course. This enables the sealing material to assume a shape that completely matches the surfaces of the logs and associated structures after they have been worked and after they have somewhat settled into their as-built configuration.

Another significant advantage of the sealing system is that the material in the horizontal and vertical bores will adhere to the wood and yet be elastic to compensate for shrinkage of the wood upon drying and/or curing. By providing a mechanism to compensate for the shrinkage of the wood, the durability and life of the building's seals is improved.

Another advantage is that the sealant is not exposed to air which may be deleterious in that the sealant will not corrode or degenerate. Also, increased aesthetic appeal is obtained.

DETAILED DESCRIPTION OF THE DRAWINGS

Figure 1:
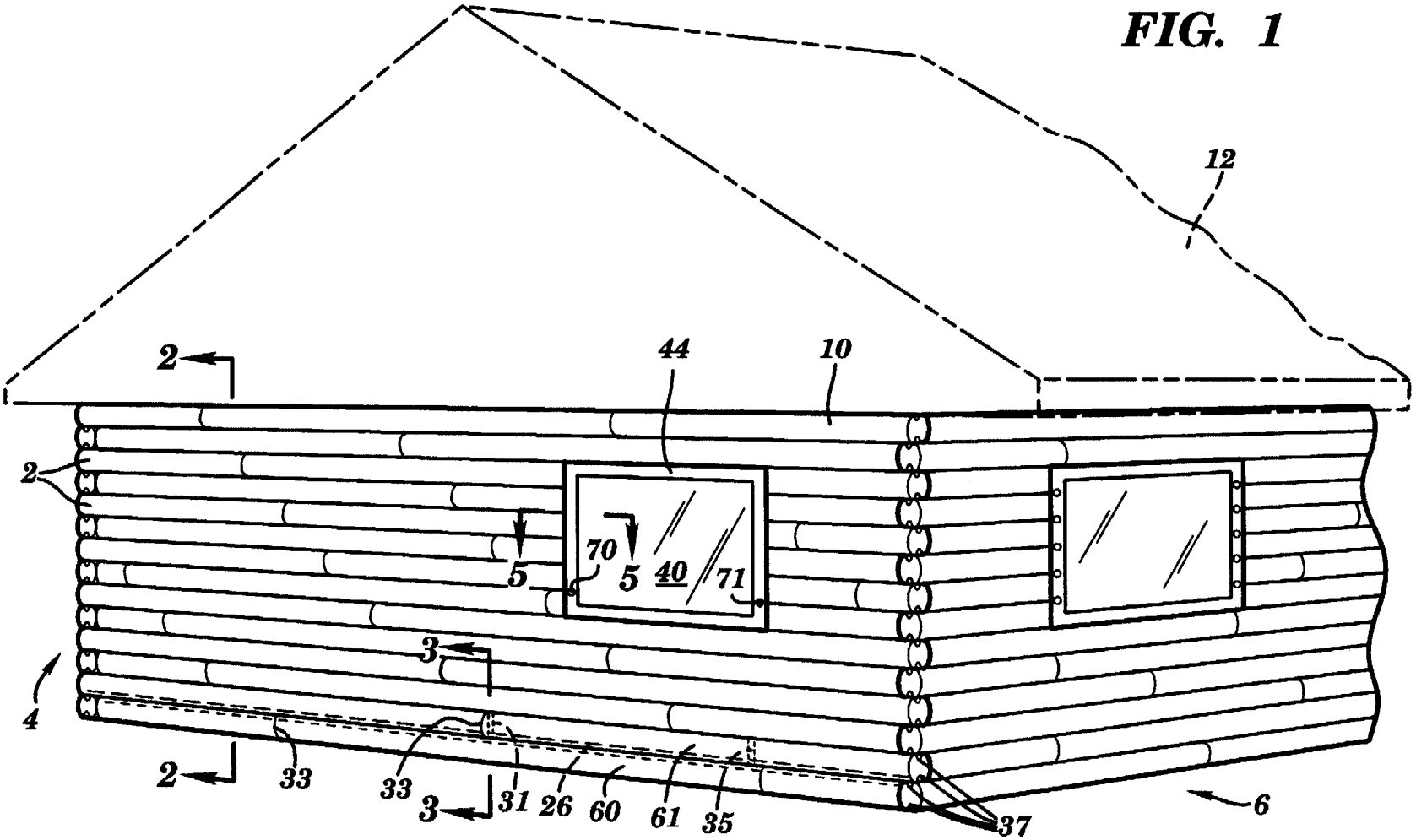
FIG. 1 is a generalized view of a portion of a log building that incorporates a sealing system in accordance with the invention.

Referring now to the drawings in greater detail, wherein like reference characters refer to like parts throughout the several figures, there is shown by the numeral 1, a wall of a log building that incorporates a sealing system in accordance with the invention.

The wall 1 is preferably part of a conventional home or commercial building (not fully shown) that employs logs as the primary wall construction material. As shown, the wall is composed of a plurality of stacked logs 2. Each log is preferably five to eighteen inches in diameter and of conventional length for building construction (preferably between five and thirty feet).

The logs are stacked one-atop another with butt and pass construction employed at each corner 4 where the wall 1 is connected to an adjacent wall 6. Optionally, other methods of corner construction can be used such as a post corner construction can be used such as a post corner (not shown). The top or header 10 of the wall provides the support/connection for the building's roof 12 (shown in phantom).

Figure 3:
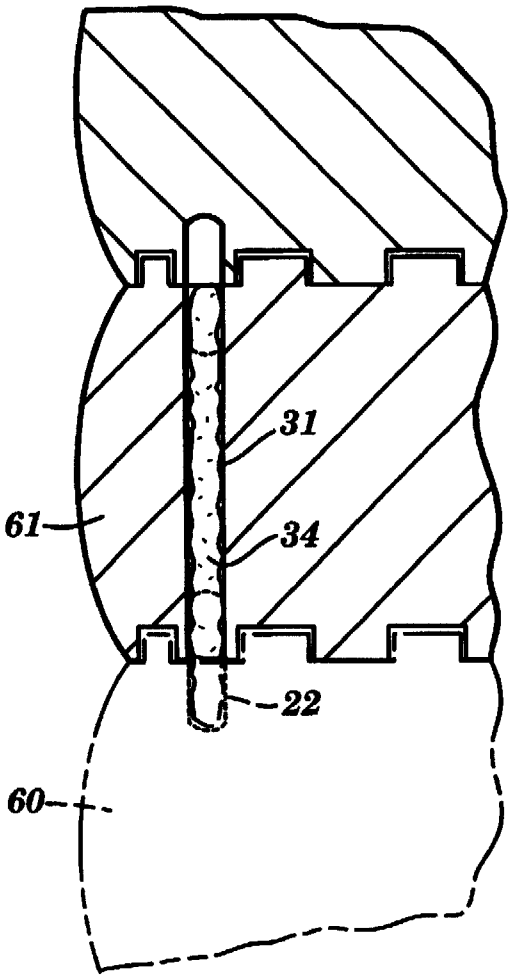
FIG. 3 is a detailed cross-sectional view of a second portion of the wall shown in FIG. 1.
Figure 2:
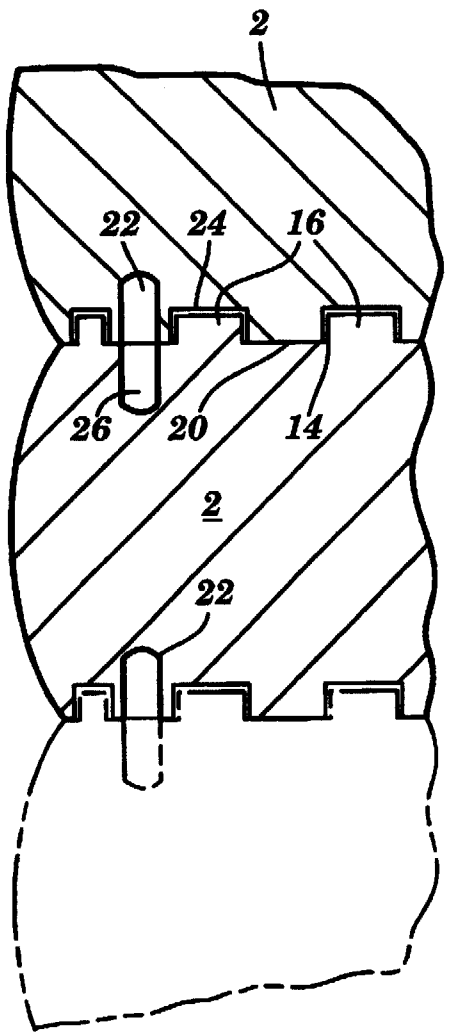
FIG. 2 is a detailed cross-sectional view of a first portion of the wall shown in FIG. 1.

FIGS. 2 and 3 provide detailed cross-sectional views of the contact areas between adjacent logs 2. As shown, each log includes a shaped top face 14 that extends for substantially its full length and includes three projecting members 16 and a groove 20. Each face also includes a groove 22 that extends its full shaped length. The bottom face 24 of each log has a shape which may be complementary to the log's top face and includes a groove 22 identical to and directly aligned with the groove 22 on the log's top face.

When one log is stacked atop another, an interlocking engagement is made due to the multiple tongue and groove connection formed as members 16 are received within groove 20 and the other shaped portions of the log's face. The grooves 22 of adjacent logs will be located as shown to form a plurality of channels 26 that extend substantially the full length of the logs. As can be seen, typical inaccuracies and mismatch due to machining and to the inherent changeability of wood due to its variable moisture retention and slight shape instability do not always enable the complementary projections and grooves, 16 and 20 respectively, to make a tight seal. Therefore, an added form of sealing is almost always required to prevent air infiltration and heat loss from occurring in the areas between adjacent logs.

In the invention, at least one vertical bore 31, approximately one-half to one inch in diameter is formed through joint 33, after one course of logs 61 has been assembled on top of another course of logs 60. After the bore 31 has been drilled, a viscous, liquid caulking/sealing material 34 is pumped into bore 31 under pressure. The caulking material flows downwards and then horizontally in each channel 26 and in each groove 22 (in the areas where there are not two adjacent grooves 22 to form a channel). Sufficient caulking material is injected into the bore 31 to completely fill all of the channels 26, isolated grooves 22 and the vertical bore 30. Blockage may be detected if caulking does not flow from the distal ends of the grooves 37. If blockage should occur in the groove 26, an additional vertical bore 35 may be formed to ensure the groove 26 is filled. The step is repeated for each course of logs.

The caulking/sealing material 34 may be a conventional silicone or other type of elastomeric caulking/sealing material. Liquid foam materials may also be employed. Alternatively, the material may be specially designed to facilitate its use in this application. In the preferred embodiment, the material 34 is injected into the bore(s) 30 using a conventional dispensing device, such as a resin dispenser, that has a motor driven pump and a large reservoir for the material to be dispensed.

It should be noted that portions of the grooves 22 and channels 26 enter into the corners of the building and therefore these areas are sealed due to the large quantity of the caulking material they receive during the injection process. It should also be noted that the grooves 22 may not extend to the extreme end of each log. In that case, the ends of each log form a blockage at each end of the associated groove 22 to thereby help to constrain the sealing material 34 during the injection operation when the caulking material is injected into the bore(s) 30.

Figure 5:
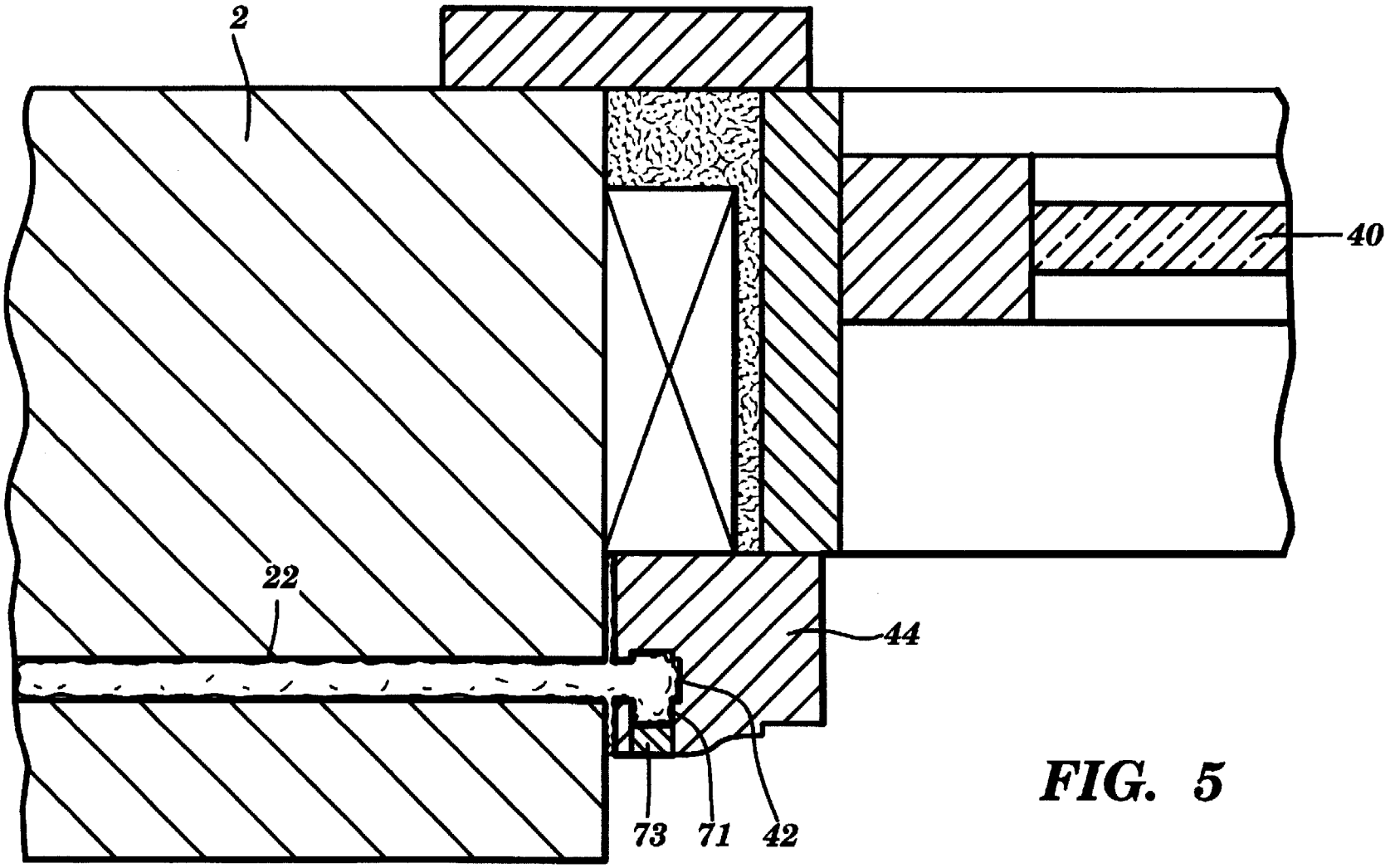
FIG. 5 is cross-sectional plan view of taken through lines 5—5 of FIG. 1.

In FIGS. 1 and 5, it can be seen that the wall includes a window 40. To seal the window, a groove 42 similar to groove 22 is milled into the outer face of the window frame prior to the frame's placement in the wall. The bore(s) extend from the top of the wall to an area proximate the window frame 44. To seal the window, liquid caulking material 34 is pumped down into bore(s) 71 and flows into the area surrounding the window frame and along the milled grooves in the frame. This allows the material 34 to fully seal the window frame in its as- built configuration. The groove is filled when caulking is seen in an opposite bore 70. A plug 73 is then placed into the bores 71, 70.

Figure 4:
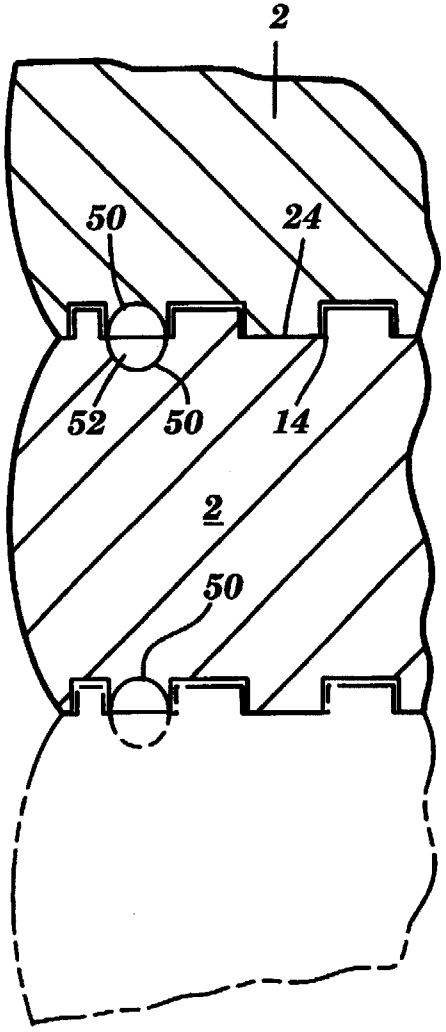
FIG. 4 is a view similar to FIG. 2 and shows a second embodiment of a thru-channel for the sealing material in accordance with the invention.

FIG. 4 shows a second embodiment of the sealing system. In this embodiment, the method of sealing is identical to that described for the first embodiment. However, the grooves 50 analogous to grooves 22 in the first embodiment, are round instead of 'U'-shaped. As can be seen in FIG. 4, the resultant channel 52 that is formed when two logs are stacked together has a round cross-section. This creates a less obtrusive channel that has a larger sealing surface area than in the first embodiment while having a cross-sectional area approximately equal to that of channel 22 of the first embodiment.

By injecting the caulking material into a reservoir (the bores 31, 35, and 42) from which the caulking material is then directed into the channels and grooves in the walls of the building, significant improvement is realized in ensuring proper sealing of the building's walls. Sufficient amounts of caulking material are able to fill even large gaps in the walls that would probably be inadequately sealed if prior art methods of gasketing or applying a bead of caulking material were employed. The method of the invention enables the caulking material to fill the grooves 22 and channels 26 over the entire period of time in which pressure is being applied to the caulking material in the bores and even afterwards due to the material's inherent adhesion and elasticity properties.

The embodiments disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

We claim:

1. A log building having multiple sealing channels, said log building comprising:

a plurality of interconnected walls, each of said walls being in the form of a plurality of stacked courses of end to end logs and wherein each course has a top surface;

a plurality of horizontally-oriented channels located between courses of logs in said walls, wherein each of said channels is formed from a pair of complementary grooves with one of said grooves located in a top surface of a course of logs and the other of said grooves located in a bottom surface of said course of logs, and wherein each of said channels extends substantially the entire length of its associated pair of courses of logs;

at least one vertically-oriented bore that extends from the top surface of one of said courses to a bottom surface of said course and wherein said bore connects to a channel on a lower surface of said course; and a quantity of injected sealing material located in said channels and said at least one bore.

2. The log building of claim 1 wherein said channels have a rectangular cross-section.

3. The log building of claim 1 wherein said channels have a circular cross-section.

4. A method of building a log wall, said method comprising:

cutting a groove along substantially the entire length of a top face of a first log;

cutting a groove along substantially the entire length of a bottom face of a second log;

placing said second log atop said first log wherein the top face of the first log is in contact with the bottom face of the second log and wherein the groove in the first log is aligned with the groove in said second log and said grooves together form a single channel;

drilling a vertically-oriented bore through said second log of said wall whereby said bore extends downwardly and through the groove in said second log; and injecting a liquid sealing material into said bore so that said material flows into the grooves in said first and second logs and thereby forms a seal between said logs.

5. The method of claim 5 further comprising the step of cutting a groove along the top face of the second log prior to its assembly with said first log.

6. A log building having multiple sealing channels, said log building comprising:

a plurality of interconnected walls, each of said walls being in the form of courses of logs, wherein each course has a top surface and a bottom surface;

a structural member selected from the group consisting of a window or door, inserted into at least one of said walls;

a groove formed in said structural member proximate said courses of logs;

a bore formed in a frame member surrounding said structural member; and a quantity of sealing material located in said groove for sealing said structural member.

* * * * *